US006305460B1

(12) United States Patent
Grolla

(10) Patent No.: US 6,305,460 B1
(45) Date of Patent: Oct. 23, 2001

(54) METHOD FOR CASTING

(75) Inventor: Herbert Grolla, Bad Laasphe (DE)

(73) Assignee: Heinrich Wagner Sinto Maschinenfabrik GmbH, Bad Laasphe (DE)

( * ) Notice: Subject to any disclaimer, the term of this patent is extended or adjusted under 35 U.S.C. 154(b) by 0 days.

(21) Appl. No.: 09/217,709

(22) Filed: Dec. 21, 1998

(51) Int. Cl.[7] ..... B22D 37/00

(52) U.S. Cl. ..... 164/119; 164/306; 164/337; 164/63; 164/136

(58) Field of Search ..... 164/119, 306, 164/337, 63, 136

(56) References Cited

U.S. PATENT DOCUMENTS 3,905,419 9/1975 Tenner ..... 164/337
5,730,203 * 3/1998 Mogensen ..... 164/119

FOREIGN PATENT DOCUMENTS 1 410 770 10/1975 (GB) .
1410770 * 10/1975 (GB) ..... 164/119
WO93/11892 6/1993 (WO) .
WO95/32826 12/1995 (WO) .

* cited by examiner

*Primary Examiner*—Tom Dunn
*Assistant Examiner*—Kevin P. Kerns
(74) *Attorney, Agent, or Firm*—Flynn, Thiel, Boutell & Tanis, P.C.

(57) ABSTRACT

In order to increase casting production during a filling of a mold from below, whereby an uptake for the casting mass is provided in the molding sand of the mold, immediately after the filling of the mold has been concluded a part of the uptake, which part extends in the molding sand, is interrupted and thus closed off so that the mold can be immediately separated from the casting container.

10 Claims, 5 Drawing Sheets

METHOD FOR CASTING

FIELD OF THE INVENTION

The invention relates to a casting method for filling a mold from below with a casting mass from a casting container through an uptake into the molding sand of the mold and for facilitating the flowing in of the casting mass rising up from below and entering into the mold, and a mold for such a method.

BACKGROUND OF THE INVENTION

The casting mass is in such a casting method subjected to a feed pressure, which, after casting, must be maintained sufficiently long until the casting mass has rigidified in the mold so that it cannot return into the casting container. Only then is it possible to remove the feed pressure and to exchange the filled mold for a new mold for the next casting. The time required for cooling off of the casting mass filled into the mold slows down the casting process because the filling of a mold via a riser passageway for the casting mass is a very economical method, which can also be used for molds made of molding sand, which molds can be manufactured quickly and in large numbers; the waiting periods required for the cooling off of the casting mass are therefore especially annoying.

SUMMARY OF THE INVENTION

The basic purpose of the invention is therefore to provide such a method and an associated mold in such a manner that the feed pressure for feeding of the casting mass from the casting container into the mold can cease immediately after the mold has been filled with casting mass.

The purpose is attained according to the invention wherein directly after the filling of the mold has been completed, the molding sand in which is provided the uptake is interrupted and is thus closed off so that the mold can be separated from the casting container. The mold and the mold container are flow-coupled in relationship to the casting mass and the feed pressure can thereafter be removed. A new mold can directly thereafter be flow-connected to the casting container so that the casting process can already be started anew when the earlier cast mold has not yet rigidified. Such a casting method can therefore be advantageously utilized in a continuously running manufacturing process.

A particularly advantageous development of the invention is experienced by the casting method when the casting mass stored in the casting container is subjected to a pneumatic feed pressure on its surface, and the casting mass is pressed through at least one vertically extending first uptake terminating at one end in the casting mass, and through a second uptake aligned with the first uptake and forming with same a common uptake pipeline for facilitating the filling of the casting mass into the mold provided above the uptake. The entire uptake pipeline extends hereby vertically and is accessible in the area of the second uptake to a constriction carried out in the mold.

Thus it is possible that a thin blocking slide, for example a metal strip, is moved into the uptake transversely with respect to its axis and covering its cross section. The metal strip can thereby be guided by a piston rod or also manually into the area of the uptake through the molding sand. It is even easier when the uptake is constricted in a preferably short partial area on a lower part of the mold through a horizontal force of at least one preferably hydraulically operated piston rod, which force is applied transversely with respect to its axis, and moves and/or compresses the molding sand; the uptake is thereby closed off merely by moving and/or compressing the molding sand, whereby immediately after the flow into the uptake is interrupted the feed pressure onto the surface of the casting mass is stopped so that the desired continuous operating process is achieved because the mold can now be immediately replaced.

Such a mold, which is suited for the method of the invention, is characterized, for example, in such a manner that a channel is provided in the molding sand, which channel extends preferably into the vicinity of the uptake, is oriented transversely with respect to the axis of the uptake, is formed into the molding sand and is displaced by the piston rod. The channel can be provided with a plug, which plug can be forced into the uptake by the piston rod in such a manner that same is blocked. Instead it is also possible that the channel is designed as a slide guide, in which a disk-shaped slide is provided so that a flow passage provided in the slide and adapted to the flow cross section of the uptake pipeline is just aligned with the uptake, whereby the slide with the help of the piston rod can be moved so far that the uptake pipeline is blocked. In the case of a stationarily arranged mold, the uptake lies either in or parallel to the mold parting plane of the mold, whereas the uptake in a mold, which is lying on its side 90° offset from the aforementioned position, is arranged perpendicularly with respect to the mold parting plane. The channel must be constructed wider in a mold which is lying on its side so that a guiding in and a relative movement of the piston rod for closing of the uptake is possible.

BRIEF DESCRIPTION OF THE DRAWINGS

The invention will be discussed in greater detail hereinafter in connection with one exemplary embodiment and the drawings, in which.

DETAILED DESCRIPTION

Figure 2:
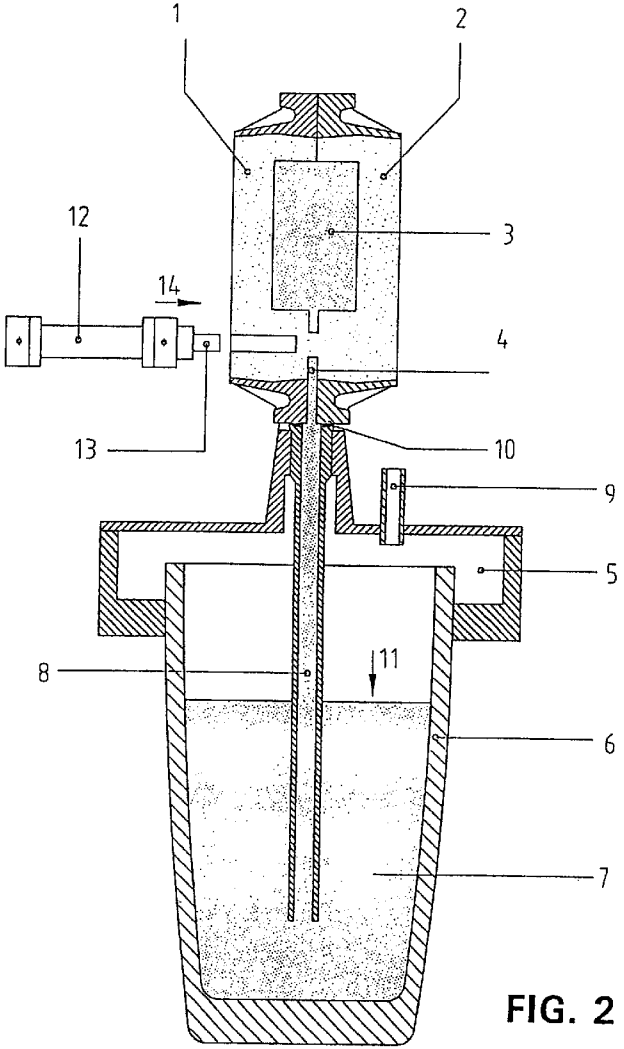
FIG. 2 illustrates the arrangement of FIG. 1 directly after the casting task and the closing of the uptake.

A mold 1, 2 according to the invention consists of two vertically divided mold halves 1 and 2 with a mold cavity 3 enclosed by molding sand, into which cavity terminates a central, vertically downwardly directed uptake 4 formed into the molding sand; the uptake 4 with a most advantageously circular cross section terminates at the other end at a free end face 10 of an also vertically designed uptake 8 which is aligned with the uptake 4 and forms therewith an uptake pipeline 4, 8 for a casting mass 7 as long as the mold 1, 2 is mounted on a casting container 5, 6. The casting container 5, 6 is composed of a pot 6 and a head piece 5 mounted on the pot 6, which head piece tightly closes off the pot 6 and has, aside from the centrally arranged uptake 8, also a connection 9, which both terminate at a level above the surface 11 of the liquid casting mass 7 in the pot 6.

The casting mass 7 is force fed into the mold cavity 3 through the uptake pipeline 4, 8 when the mold 1, 2 is mounted on the casting container 5, 6. This force feeding is caused by the surface 11 being subjected to a pneumatic feed pressure p applied to and through the connection 9 to flow-connect the casting container 5, 6 to a compressed-air source (not shown).

A hydraulic piston motor 12 is installed at the height of the uptake 4 and directed transversely to its extent, the piston rod 13 of which can be moved into the mold 1, 2 in a direction 14 perpendicular to the axis of the uptake 4, and applies thereby a sand displacement force onto the molding sand provided in the mold.

Figure 1:
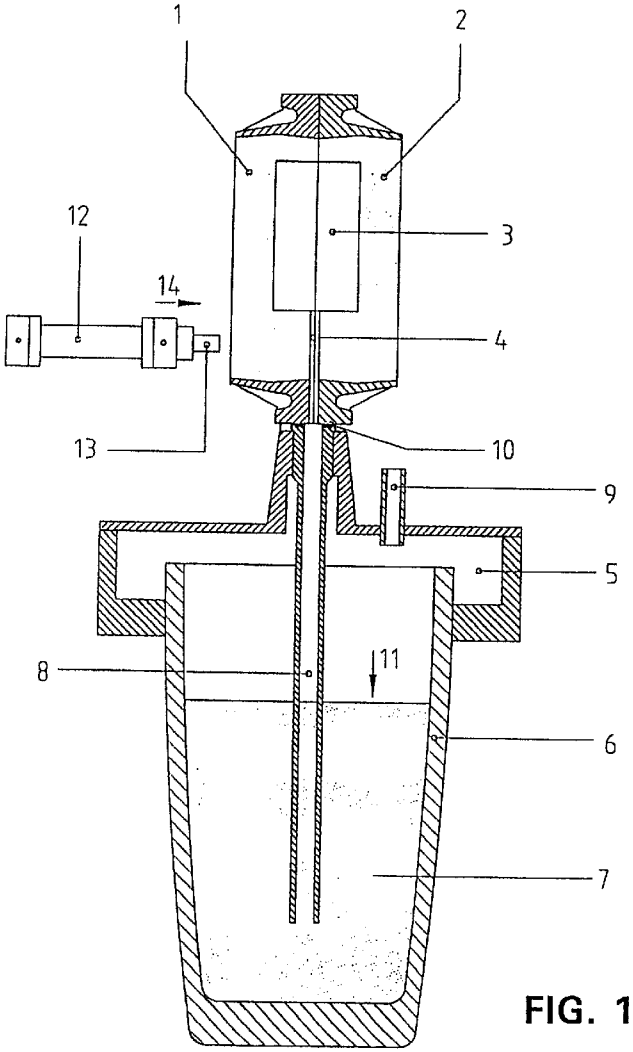
FIG. 1 is a longitudinal cross-sectional view of a casting arrangement with a stationary mold prior to the casting, which arrangement is suitable for the method of the invention.

The piston rod 13 applies in the arrangement of FIGS. 1 and 2 its force directly onto the molding sand which completely forms the mold 1, 2. As shown in FIG. 2, the piston rod 13 is moved after casting sufficiently far into the molding sand of the mold 1, 2 until the uptake 4 is interrupted by compressed molding sand which is pressed into the cross section of the pathway of the uptake 4 to close off the uptake so that a return of the casting mass 7 already filled into the mold chamber 3 is prevented. It is understood that a further piston rod diametrically opposite to the first one can be provided in order to also correspondingly displace the molding sand on the opposite side of the mold 1, 2, and in order to be able in this manner to constrict the uptake 4 from two sides.

Figure 4:
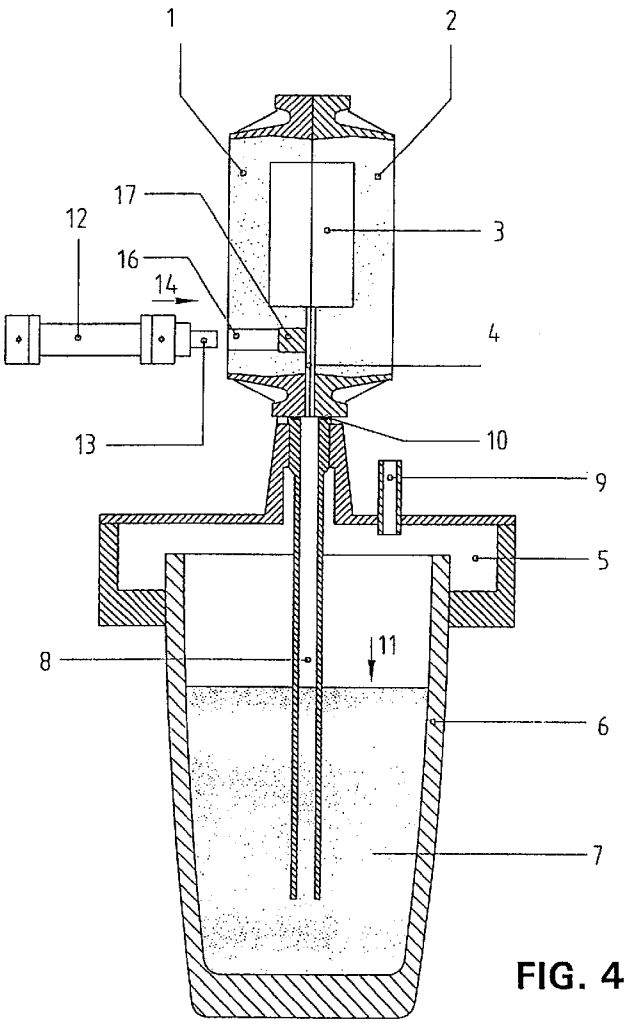
FIG. 4 illustrates a casting arrangement as shown in FIG. 3 with a special closure part for the uptake of the mold.
Figure 6:
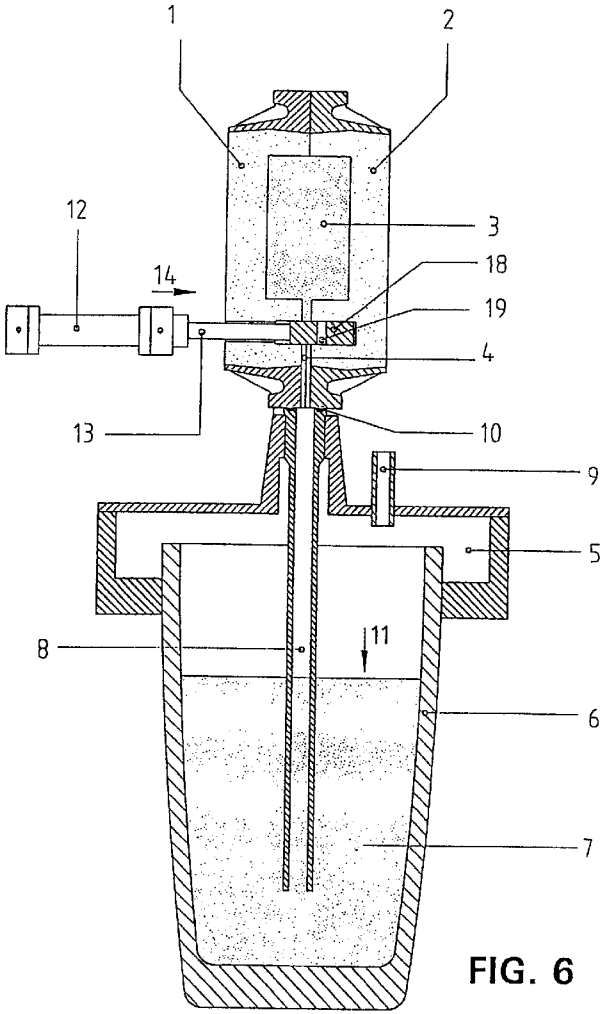
FIGS. 5 and 6 illustrate a casting arrangement with a further modification of the mold of FIG. 3.
Figure 5:
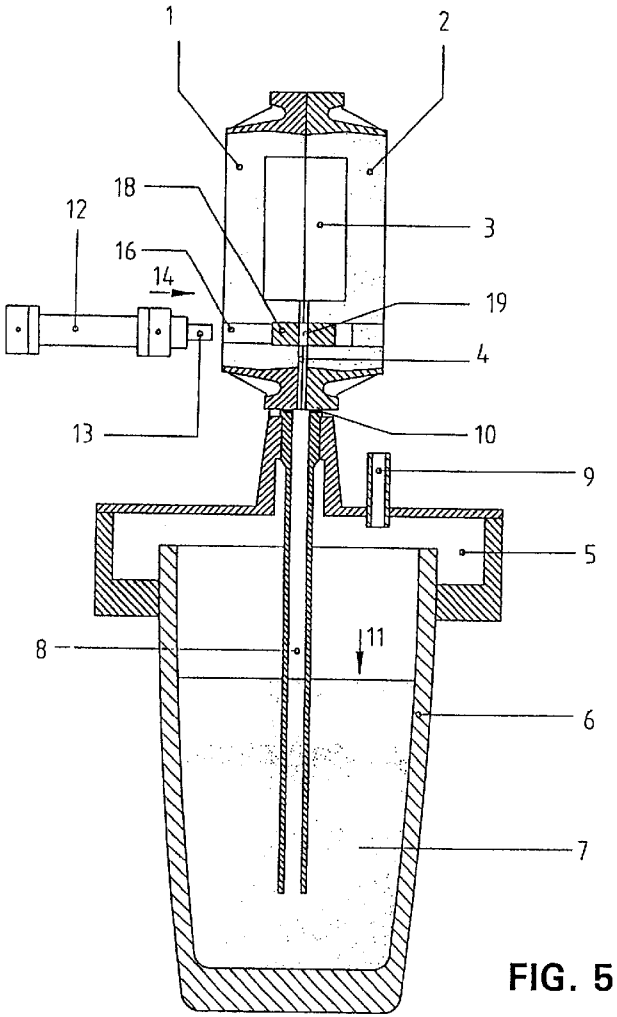

In contrast to this, the embodiments of FIGS. 3–6 show an elongate piston rod receiving channel 15 or 16 formed into the molding sand of the mold 1, 2, which channel extends in the direction 14 and corresponds in cross section to the cross section of the piston rod 13, and extends to the uptake 4 (FIGS. 3, 4) or beyond (FIGS. 5, 6).

Figure 3:
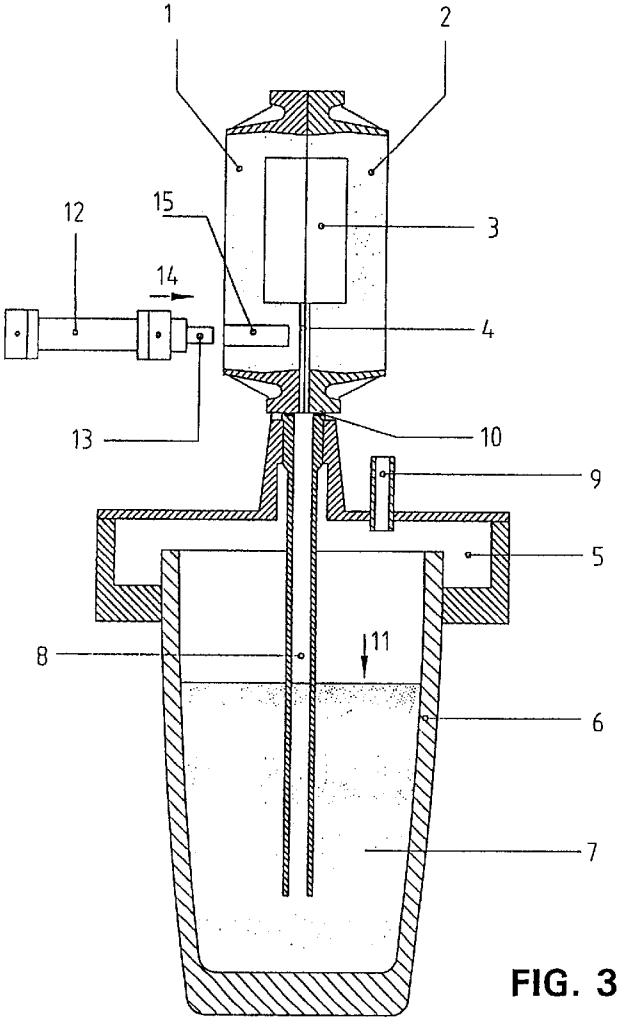
FIG. 3 illustrates a casting arrangement as shown in FIGS. 1 and 2 with a slightly changed mold.

Whereas according to FIG. 3 the piston rod receiving channel 15 can solely serve the purpose to ease the work of the piston rod 13, a plug 17 is in the arrangement of FIG. 4 placed into a preformed fitting receiving channel 16, which plug can be moved by the piston rod 13 until the uptake 4 is closed. Such a design is particularly advantageous when the molding sand is chemically bound and opposes the piston rod 13 with a suitably high resistance when same is moved into the molding sand.

A further embodiment of a casting arrangement of the invention is shown in FIGS. 5, 6 and after the casting task. Here a slide 18 is placed into the channel 16, which channel extends sufficiently far into the molding sand that the slide 18, without any further compressing of the molding sand by the piston rod 13, can be moved a sufficient distance after the casting task has ended so that a flow passage 19 provided in the slide 18, provided before and during the casting process (FIG. 5) in the area of the uptake 4 and forming a part of the uptake 4, 8 is no longer effective (FIG. 6), namely it blocks the uptake 4 to the mold 1, 2, and thus also prevents a return of the casting mass 7 from the mold 1, 2.

In the casting arrangement illustrated in FIGS. 7 to 10, the same parts have associated therewith the same reference numerals. This casting arrangement differs from the one according to FIGS. 1 to 6 essentially in such a manner that the mold is lying 90° from the position shown in FIGS. 1–6, which has the advantage that a lesser static pressure builds up within the mold.

Figure 8:
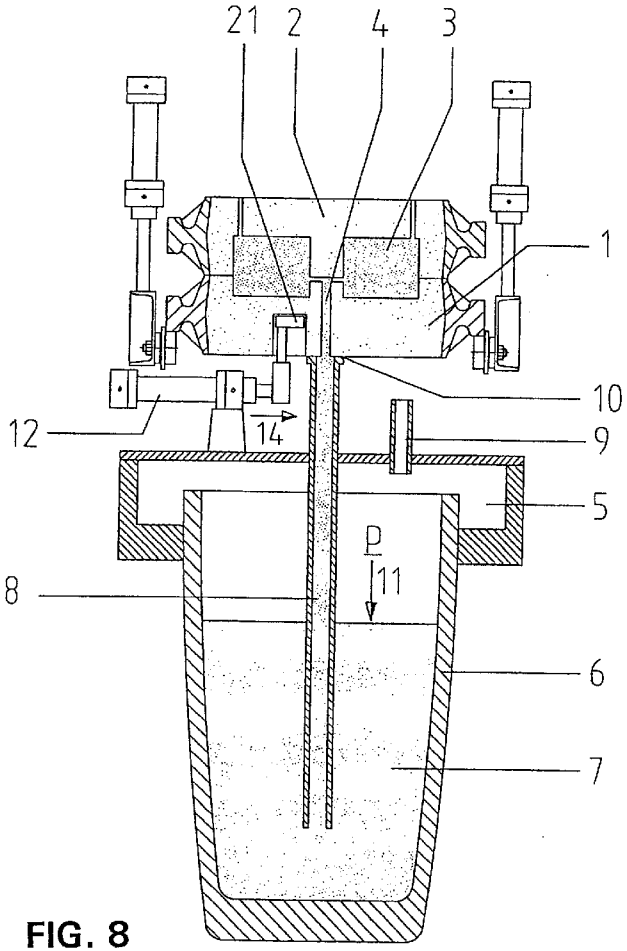
FIGS. 7 to 10 illustrate a casting arrangement for a mold lying on its side, all in a schematically simplified illustration.
Figure 7:
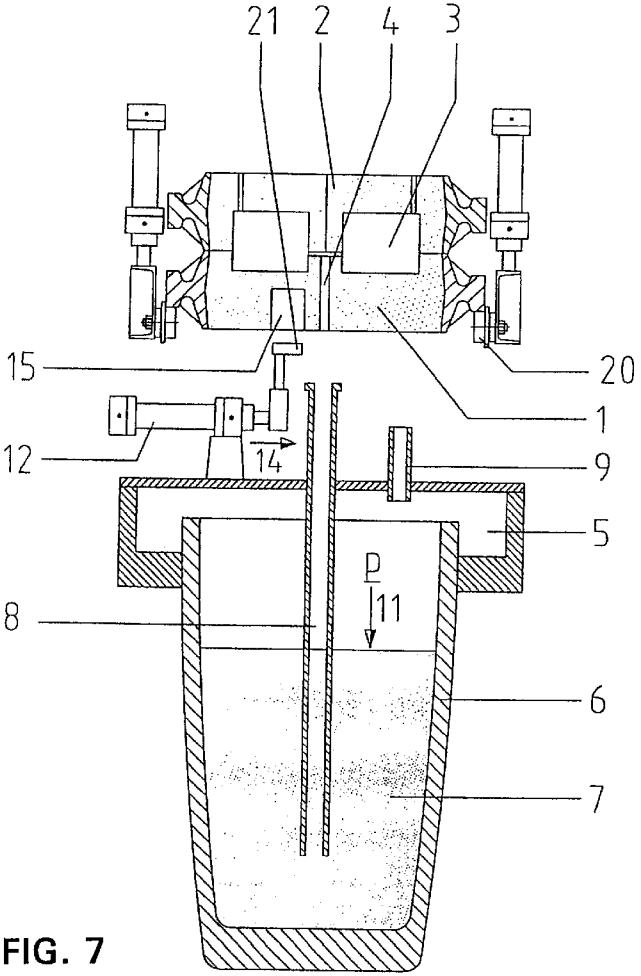
Figure 10:
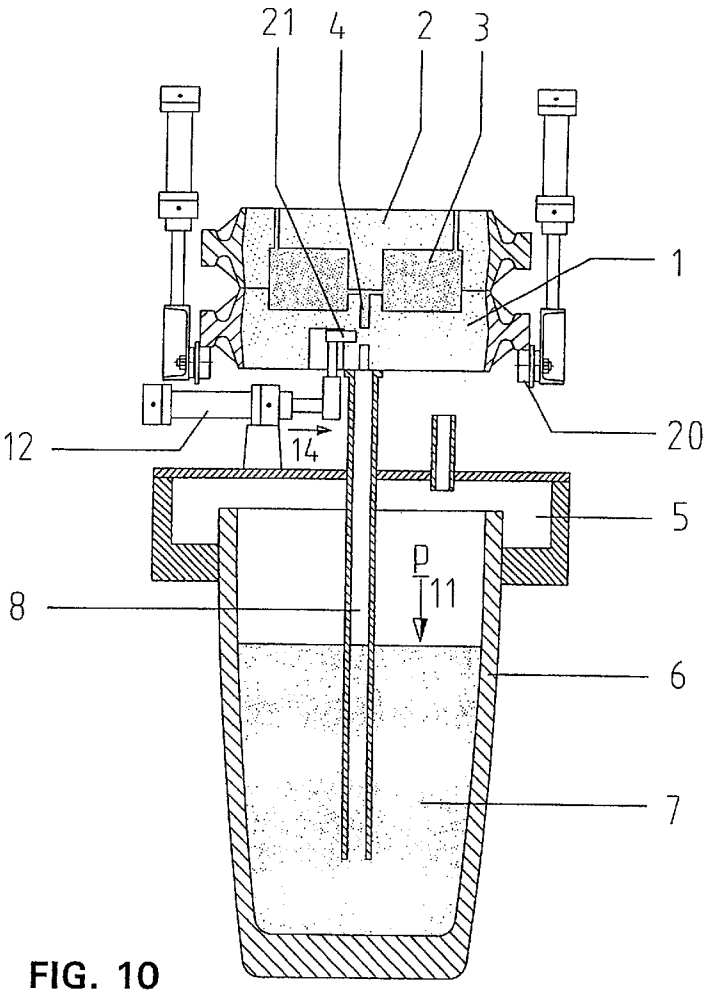
Figure 9:
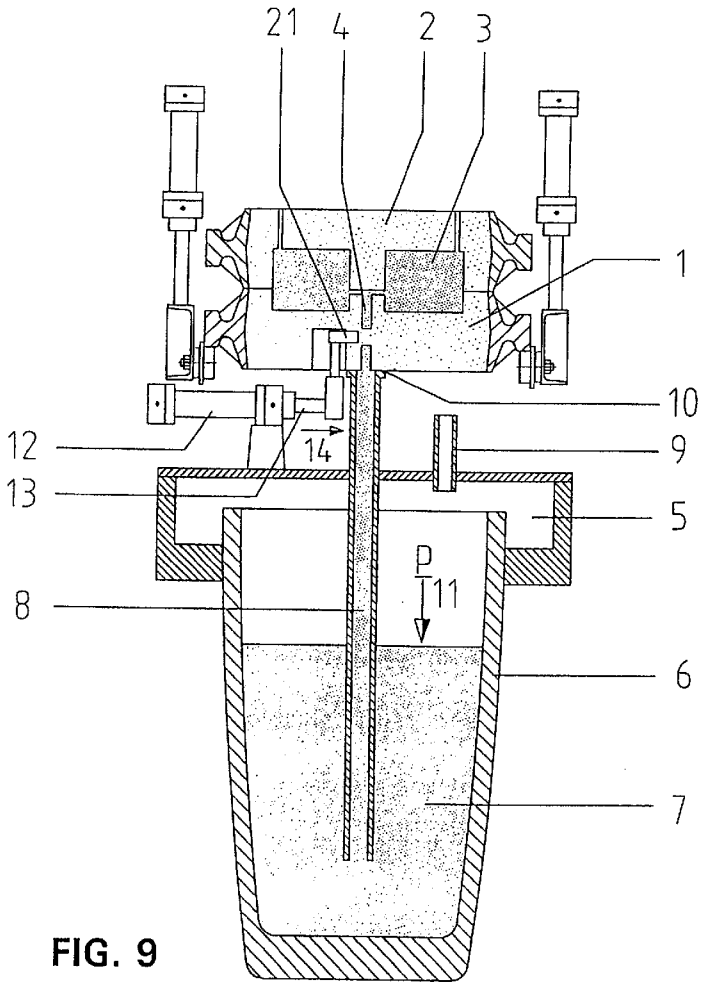

The mold is moved on a transport track 20 to the casting arrangement, whereat it is lowered so that the uptake 8 closely interfaces with an aligned uptake 4. The mold is thereafter filled through the uptake 8, as this is illustrated in FIG. 8. The pressure piece 21, which extends into the channel 15, is moved by a pneumatic cylinder 12 so that, as this is illustrated in FIG. 9, the sand is pressed into the uptake 4 and closes same off. FIG. 10 illustrates the position, in which the uptake 4 is closed off and the pressure piece 21 is again retracted. The mold 1, 2 is then lifted and is transported on the transport track 20. Otherwise this embodiment corresponds with the one described in FIGS. 1 to 6 so that reference is made to these figures.

I claim:

1. A casting method for filling of a two piece mold formed by two mold half sections, comprising the steps of:

joining the two mold half sections so that grooves therein form a downwardly extending straight uptake from a mold cavity;

positioning the mold half sections onto a casting container by vertically aligning the uptake with a feed tube of the casting container, the mold half sections forming the two piece mold with a closed top and the mold cavity connected to the feed tube by the uptake, the closed top of the mold being free from additional elements;

applying a feed pressure (p) to the casting container through a connection;

in response to the feed pressure, force feeding a casting mass from the casting container through the feed tube and into the mold cavity through the uptake;

stopping application of the feed pressure immediately after feeding of the casting mass into the mold cavity when the mold cavity is substantially full of the mass to form a cast piece;

applying a horizontal force to a lower part of the mold, substantially perpendicular to the length of the uptake to interrupt feeding of the casting mass into the mold cavity and close the uptake at a closing position adjacent to and closer to a lower end of the mold cavity than to an upper end of the feed tube;

removing the mold from the casting container; and securing another mold having first and second mold sections to the casting container, wherein the closing of the uptake defines an upper uptake portion above the closing position having casting mass within and a lower uptake portion below the closing position, the casting mass in the lower uptake portion being capable of returning to the casting container through a vertically aligned feed tube, and wherein closing the uptake at a position adjacent the mold cavity minimizes the amount of waste of casting mass.

2. The method according to claim 1, wherein the step of closing the uptake comprises forcing molding sand into the uptake.

3. The method according to claim 1, wherein an outwardly open die channel is formed into molding sand and oriented transversely with respect to the axis of the uptake.

4. The method according to claim 3, wherein a plug is oriented in the channel, and the step of closing the uptake comprises the step of applying a force to press the plug into the uptake, the plug dividing the casting mass, the casting mass in the upper uptake portion being fixed to the cast piece so that molding sand is not contaminated by portions of the casting mass.

5. The method according to claim 3, wherein the step of closing the uptake comprises the step of moving a rod into the die channel and applying force so that the end of the rod moves the molding sand which closes the uptake and divides the casting mass in the uptake, the casting mass in the upper uptake portion being fixed to the cast piece so that the molding sand is not contaminated by portions of the casting mass.

6. A casting method for filling of a mold having two mold half sections, the mold having an uptake, comprising the steps of:

positioning the mold half sections onto a casting container while vertically aligning the uptake with a feed tube of the casting container to provide a direct path for casting mass from the casting container to a mold cavity in the mold;

applying a feed pressure (p) to the casting container through a connection;

in response to the feed pressure, force feeding the casting mass from the casting container through the feed tube and into the mold cavity through the uptake;

stopping application of the feed pressure immediately after feeding of the casting mass into the mold cavity when the mold cavity is substantially full of the mass to form a cast piece;

applying a substantially horizontal force into a die channel in a lower part of the mold, the die channel being substantially perpendicular to the length of the uptake and ending at a location near the uptake to interrupt feeding of the casting mass into the mold cavity and close the uptake at a closing position adjacent to and closer to a lower end of the mold cavity than to an upper end of the feed tube;

removing the mold from the casting container; and securing another mold having first and second mold sections to the casting container, wherein the closing of the uptake defines an upper uptake portion above the closing position having casting mass within and a lower uptake portion below the closing position, casting mass in the upper intake portion being fixed as a waste piece to a casting piece in the mold cavity and the lower uptake portion returning casting mass to the casting container through a vertically aligned feed tube so that, other than the cast piece and waste piece, all remaining casting mass returns to the casting container except for any casting mass in the lower uptake portion that solidifies before returning to the casting container.

7. The method according to claim 6, wherein the step of closing the uptake comprises forcing molding sand into the uptake.

8. The method according to claim 6, wherein a plug is oriented in the channel, and the step of closing the uptake comprises the step of forcing the plug into the uptake, the plug dividing the casting mass.

9. The method according to claim 6, wherein the mold has a closed top.

10. A casting method for filling of a mold having two mold half sections, one of the mold half sections having a straight linear uptake therethrough, comprising the steps of:

positioning the mold half sections onto a casting container while vertically aligning the uptake with a feed tube of the casting container to provide a direct path for casting mass from the casting container to a mold cavity in the mold;

applying a feed pressure (p) to the casting container through a connection;

in response to the feed pressure, force feeding the casting mass from the casting container through the feed tube and into the mold cavity through the uptake;

stopping application of the feed pressure immediately after feeding of the casting mass into the mold cavity when the mold cavity is substantially full of the mass to form a cast piece;

applying a substantially horizontal force into a die channel in a lower part of the mold, the die channel being substantially parallel to the length of the uptake and adjacent the uptake, the horizontal force being applied by a rod movable in the horizontal direction and a pressure piece secured at one end to the rod and projecting upwardly into the die channel, and a contact piece secured to the other end of the pressure piece and aligned horizontally and projecting toward the uptake at a closed top end of the die channel for horizontal movement during movement of the rod to interrupt feeding of the casting mass into the mold cavity and close the uptake at a closing position adjacent to and closer to a lower end of the mold cavity than to an upper end of the feed tube;

removing the mold from the casting container and advancing the mold along a transport track; and securing another mold on the transport track to the casting container, wherein the closing of the uptake defines an upper uptake portion above the closing position having casting mass within and a lower uptake portion below the closing position, casting mass in the upper intake portion being fixed as a waste piece to a casting piece in the mold cavity and the lower uptake portion returning casting mass to the casting container through a vertically aligned feed tube so that, other than the cast piece and waste piece, all remaining casting mass returns to the casting container except for any casting mass in the lower uptake portion that solidifies before returning to the casting container.

* * * * *